US006762559B1

(12) United States Patent
Ishikawa et al.

(10) Patent No.: US 6,762,559 B1
(45) Date of Patent: Jul. 13, 2004

(54) HIGH-PRESSURE MERCURY DISCHARGE LAMP AND LIGHTING APPARATUS USING THE LAMP

(75) Inventors: Satoko Ishikawa, Kanagawa-ken (JP); Ichiro Tanaka, Kanagawa-ken (JP); Hiromichi Kawashima, Kanagawa-ken (JP); Hisashi Yoshida, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 381 days.

(21) Appl. No.: 09/737,822

(22) Filed: Dec. 18, 2000

(30) Foreign Application Priority Data

Dec. 27, 1999 (JP) ..... 11-370595

(51) Int. Cl.[7] ..... H01J 17/20
(52) U.S. Cl. ..... 313/639; 313/637; 313/640
(58) Field of Search ..... 313/636, 638, 313/640, 641, 639, 637, 570, 571

(56) References Cited

U.S. PATENT DOCUMENTS 5,668,441 A * 9/1997 Genz ..... 313/637
5,905,341 A * 5/1999 Ikeuchi et al. ..... 313/639
6,107,742 A * 8/2000 Seki et al. ..... 313/639

FOREIGN PATENT DOCUMENTS

JP 6-52830 2/1994
JP 11-297269 10/1999

OTHER PUBLICATIONS

Toshiba Lighting & Technology Corporation Explanation of Background Art Information (No Date).

* cited by examiner

*Primary Examiner*—Don Wong
*Assistant Examiner*—Jimmy T. Vu
(74) *Attorney, Agent, or Firm*—Pillsbury Winthrop LLP

(57) ABSTRACT

A high-pressure mercury discharge lamp comprises a light-transmitting discharge vessel having a region surrounding a discharge space and seal portion, a spaced apart electrodes disposed in the discharge vessel and defining a discharge path, and a filling contained in the discharge vessel including mercury, halogen and lithium (Li). Components of the filling are selected such that a ratio of relative spectral energies B/A is within a range 0.15 to 0.45; wherein A represents the relative spectral energy of mercury (Hg) within a wavelenth range of 402.5 nm to 407.5 nm, and B represents the rlative spectral energy of lithium (Li) within a wavelength range of 667.5 nm to 672.5 nm.

10 Claims, 4 Drawing Sheets

HIGH-PRESSURE MERCURY DISCHARGE LAMP AND LIGHTING APPARATUS USING THE LAMP

BACKGROUND OF THE INVENTION

1. Field of Invention

The present invention relates to a high-pressure mercury discharge lamp, which contains an ionizable filling including at least lithium (Li), and a lighting apparatus using the lamp.

2. Description of Related Art

In view of the increasing popularity of LCD projectors, there is increased demand for lighting sources that can be effectively and efficiently utilized in such devices. It is desired that such lighting sources be small, bright, and have the proper color balance. Usually, such light sources are used to back light an LCD. Light passing through the LCD is then projected onto a screen. In order to make the high-pressure mercury discharge lamp as small as possible, it is desirable to minimize the distance between electrodes of the lamp. This arrangement requires that the voltage across the electrodes be lower than the voltage across electrodes that are further apart in other lamp arrangements. Therefore the lamp must be operated at a higher current than lamps whose electrodes are further apart. The higher current requirement, in turn, requires a that a larger ballast be used for starting the lamp. Thus, an LCD projector including the lamp and its required ballast must be made relatively larger.

Japanese Laid Open Patent Application HEI 6-52830 (prior art 1) discloses a high-pressure mercury lamp utilizing an arc discharge shortening technique that does not require lowering the lamp voltage. Rather, the pressure of the filling gas is raised, which allows for higher voltage operation even though electrode spacing is reduced. The lamp of prior art 1 lights up at high-pressure mercury vapor, e.g., 10 Mpa or more during the lamp operation to provide sufficient illuminance and color rendering so as to be suitable for use in a small size projector.

In order to maintain an arc discharge, the lamp which is disclosed in Japanese Laid Open Patent Application HEI 11-297269 (prior art 2), contains a metal halide including one or more selected form a group of lithium (Li), sodium (Na), cerium (Ce), barium (Ba) and calcium (Ca). A discharge vessel of the lamp contains the metal halide of $2*10^{-4}$ to $7*10^{-2}$ $\mu$mol/mm$^3$. The ionizing voltage of a metal halide is 0.87 times or less than that of mercury (Hg). Such a lamp radiates more energy in the red portion of the color spectrum, so that the lamp has improved color rendering.

SUMMARY OF THE INVENTION

The inventions claimed herein, at least in one respect, feature a high-pressure mercury discharge lamp and a lighting apparatus using the lamp. The lamp and lighting apparatus are able to provide improved color rendering and color temperature without sacrificing luminous efficacy.

In one embodiment of the invention, a high-pressure mercury discharge lamp is provided. It includes a light-transmitting discharge vessel defining a discharge space and having a seal portion. Spaced apart electrodes disposed in the discharge vessel define a discharge path. A gas filling contained in the discharge vessel includes mercury, halogen and lithium (Li), whose relative spectral energy distributions are shown in FIG. 2. It is preferable that the relative spectral energies B/A be in a range of 0.15 to 0.45; wherein A represents the relative spectral energy of mercury (Hg) within the 402.5 nm to 407.5 nm wavelength range, and B represents the relative spectral energy of lithium (Li) within 667.5 nm to 672.5 nm wavelength range.

The inventions also include a lighting apparatus. The lighting apparatus includes a high-pressure mercury discharge lamp, a reflector fixing the lamp focusing the center of discharge vessel on the focal point thereof and a housing accommodating the lamp and the reflector.

These and other aspects of the invention are further described in the following drawings and detailed description of the invention.

BRIEF DESCRIPTION OF THE DRAWINGS

In the following, the invention will be described in more details by way of examples illustrated by drawings in which.

DETAILED DESCRIPTION

Figure 1:
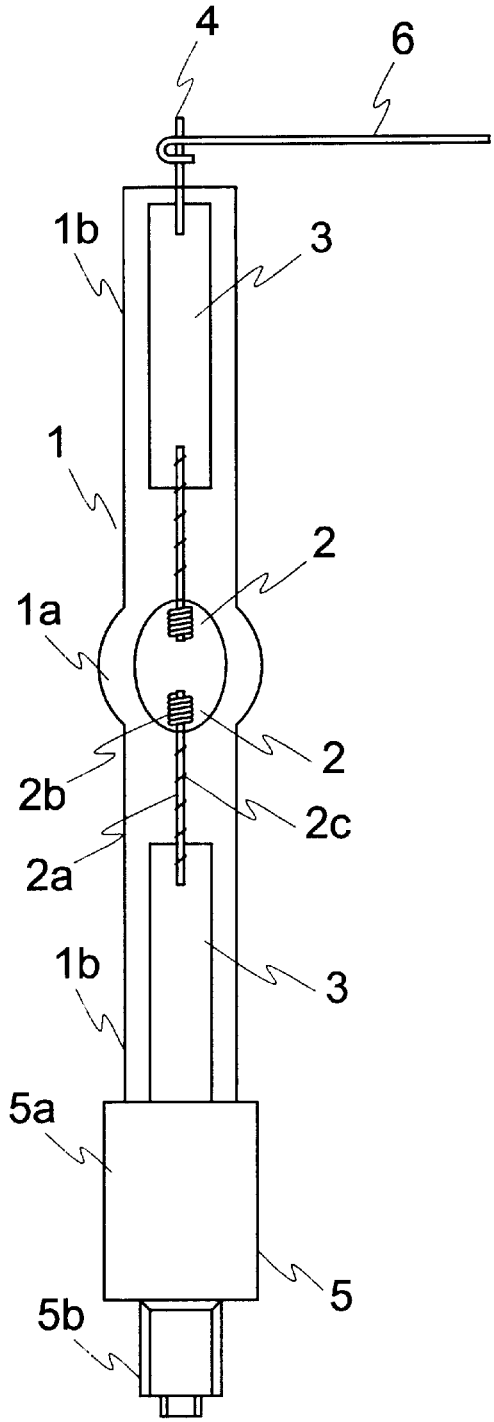
FIG. 1 is a front view of a high-pressure mercury discharge lamp according to first embodiment of the present invention.

A first exemplary embodiment of the invention will be explained in detail with reference to FIGS. 1 and 2. A high-pressure mercury discharge lamp, shown in FIG. 1, comprises a discharge vessel 1, which is made of quartz glass. Vessel 1 is shaped so as to have an elliptical region surrounding a discharge space 1*a* and a pair of seals 1*b*, 1*b* extending from the elliptical region. In this example, the elliptical region has maximum diameter of 9 mm. However, the principles of the invention can be applied to other shapes as well. For example, the vessel could have a bulbous shape or even some other shape. Vessel 1 may include on its inner surface a transparent film, whose quality is not changed by halogen.

A pair of electrodes 1*b*1, 1*b*1 is disposed in the discharge vessel 1 and respectively connected to a pair of molybdenum foils 2, 2, embedded in the seals 1*b*, 1*b*. The foils have a thickness of 20 $\mu$m, a width of 1.5 mm and a length of 17 mm.

Each of the electrodes 1*b*, 1*b* is composed of an electrode rod 2*a* made of tungsten having 0.45 mm in diameter, a coil 2*b*,which is made of 0.45 mm tungsten wire in diameter, winding around the rod at one end and a sealed coil. The sealed coil made of diameter 0.075 mm tungsten wire winds around the rod overall in larger pitch and is embedded in the seals.

The sealed 2*c* acts as a shock absorber. When the electrodes vibrate, the coil can absorb the vibration. Therefore, glass contacting to the rod in the seal portion does not crack. The electrodes may be made of doped-tungsten or tungsten with thorium.

The pair of the electrodes may be constructed and arranged in the same manner when alternating current (AC) power is provided to the lamp. Each electrode may be constructed and arranged so as to have a larger diameter portion formed from the rod instead of the coil. When direct current power is provided to the lamp, one electrode operates as an anode and the other electrode does a cathode. In general, the anode, which receives electrons from the cathode, is constructed and arranged so as to be comparatively larger to radiate heat caused by electrons. The anode may be formed by sharpening a rod having comparatively larger diameter. The cathode may be made from a tungsten rod having comparatively small diameter to radiate heat electrons easily.

An arc discharge in the discharge vessel has a short length because of a narrow interspace formed between tips of the electrodes. Therefore, as a radiation of visible light from the lamp approximates to a point radiation source, the visible light is effectively reflected on the reflector. A lamp designed for use in a LCD projector, should have a distance between electrode tips of 3 mm or less. When the electrodes interspaces over 4 mm, the visible light is not satisfactorily reflected and an illuminance on a screen decreases. In the view of above, the interspace of electrodes is more preferably in a range of 0.5 mm to 2.0 mm.

The outer sides of molybdenum foils 2, 2 are connected to a pair of conductive wires 4 made of molybdenum, respectively. One conductive wire 4 is also connected to another conductive lead wire 6. The other conductive wire 4 is electrically connected to a lamp base 5, which is fixed at one end of the seal 1*b* with an adhesive agent and comprises a body 5*a* and a screw terminal 5*b*.

Discharge vessel 1 has a filling, which contains mercury, rare gas, halogen and alkaline metals including at least lithium (Li). Mercury (Hg) is appropriately filled so as to make up 80V-lamp voltage. It is preferable to fill 0.18 $mg/mm^3$ or more against volume of the discharge space. Rare gas may be argon (Ar), krypton (Kr) or xenon (Xe). Bromide (Br) as halogen is filled $7*10^{-3}$ $\mu mol/mm^3$. It is useful to fill $1*10^{-3}$ $\mu mol/mm^3$ or more against volume of the discharge space. If the halogen is not filled less than $1*10^{-3}$ $\mu mol/mm^3$, the arc discharge generated between above mentioned pair of electrodes likely transforms an unstable condition. Besides, preferably upper limit of halogen filling is $1*10^{-3}$ $\mu mol/mm^3$. The halogen may be one or more selected from a group including fluorine (F), chlorine (Cl), bromide (Br) and iodide (I).

Lithium (Li) on the order of 10 ppm can be used as the mercury halide, e.g., $HgBr_2$-Li pellets. Alkali metals may contain lithium (Li) and sodium (Na). The quantity of lithium (Li) may be regulated corresponding to a spectral energy distribution of the high-pressure mercury discharge lamp.

Therefore, the quantity of lithium (Li) defined as a B/A ratio; wherein A is mercury (Hg) integral energy within 402.5 nm to 407.5 nm of wavelength, B is lithium (Li) integral energy within 667.5 nm to 672.5 nm, is preferable to within 0.15 to 0.45.

Figure 2:
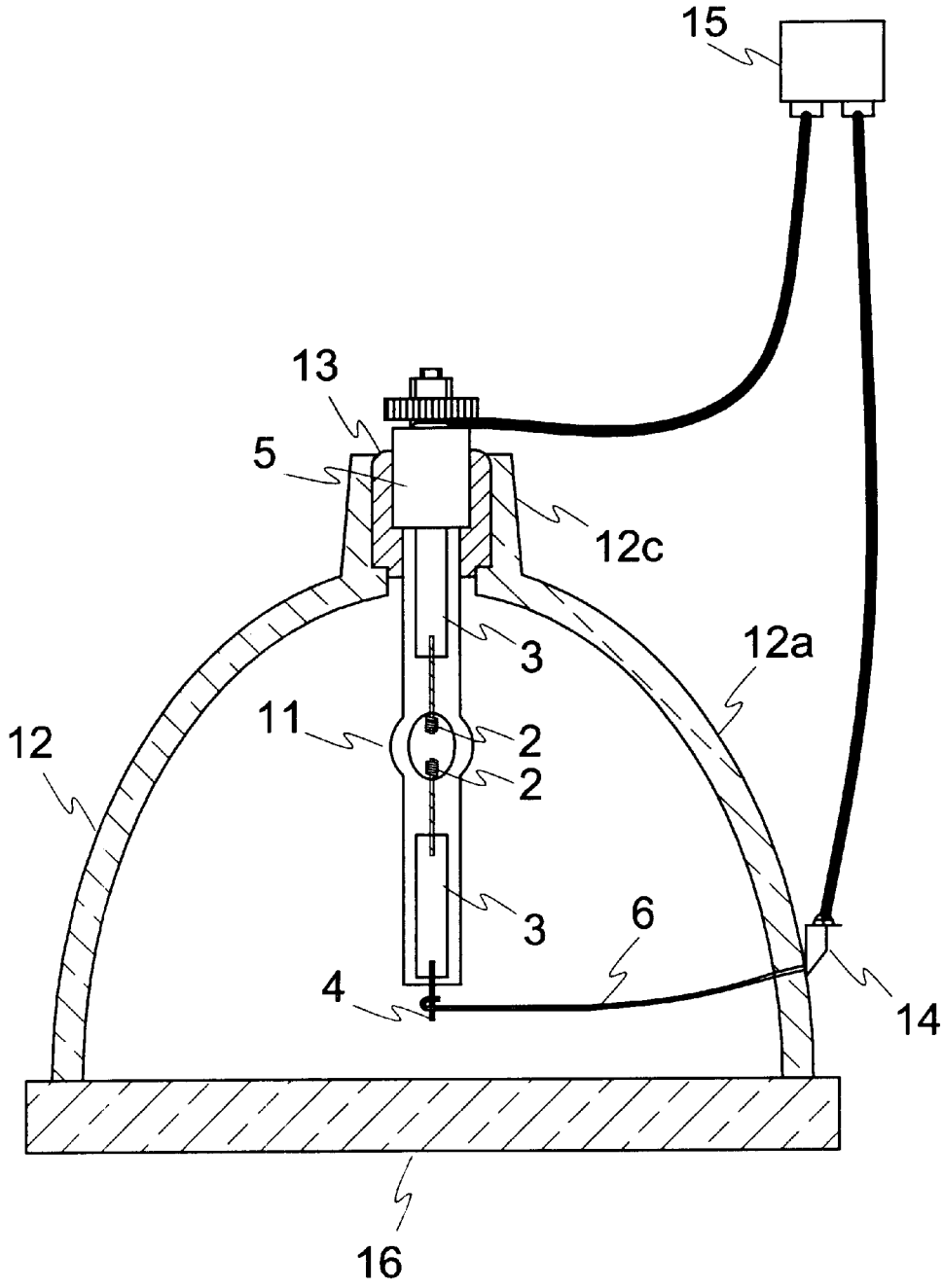
FIG. 2 is a graph showing a spectral energy distribution as a function of wavelength of the high-pressure mercury discharge lamp shown in FIG. 1.

FIG. 2 is a graphical representation of relative spectral energy distribution as a function of wavelength for the high-pressure mercury discharge lamp. The relative energy A (due to Hg) in the wavelength range of 402.5 nm to 407.5 nm is substantially constant when the lamp is operated at a pressure of at least about 1 Mpa, regardless of the inclusion of other elements in the filling gas. Of course, based on the selection of other elements, there can be variation in the overall relative energy spectrum distributions because each element has its own characteristic spectral energy. Of particular interest are the energies A and B shown in FIG. 2. "A" represents the energy due to the resonance spectrum of Hg within a wavelength range of 402.5 nm to 407.5 nm. "B" represents the energy due to the resonance spectrum of Li within a wavelength range of 667.5 nm to 672.5 nm.

When the lamp is constructed and arranged such that the B/A ratio is less than 0.15, there is insufficient red radiation part of the spectral energy distribution, and the luminous efficacy of the lamp is insufficient. When the lamp is constructed and arranged such that the B/A ratio is over 0.45, the illuminant maintenance factor decreases. Consequently, it is useful and appropriate to arrange the lamp such that the aforementioned B/A ratio is within a range of 0.15 to 0.45 to provide appropriate color rendering property and color temperature while maintaining a desirable level of luminous efficacy. The lamp operating characteristics are even better when the B/A ratio is maintained within a range of 0.20 to 0.40.

A lamp according to the invention may be operated using either alternating or direct current. It consumes power of in the range of 100W to 150W. While the high-pressure mercury discharge lamp operates, a mercury pressure rises over 15 MPa, so that the arc discharge generated between the electrodes tends to contract. Accordingly, luminous efficacy of the lamp improves over 101 m/W on a screen seeing TV pictures in compared with the example having the same lamp life of prior art.

The vertical axis of the graph shown in FIG. 2 indicates relative energy (an energy ratio measured as a percentage and the horizontal axis indicates wavelength. The energy ratio (%) is a relative number of spectral energy integrated every 5 nm in wavelength against the amount of energy within a wavelength range of 547.5 nm to 552.5 nm. As shown in FIG. 2, Lithium (Li) causes a high color rendering property and respective low color temperature. In this embodiment, the B/A ratio is about 0.35.

Figure 3:
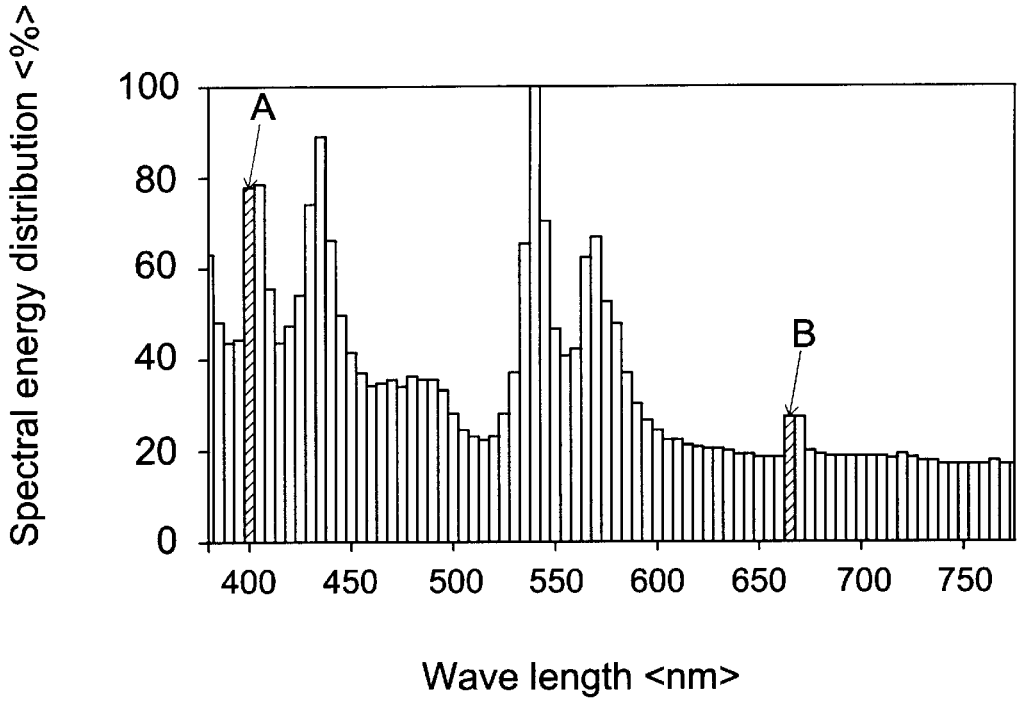
FIG. 3 is a cross section of a high-pressure mercury discharge lamp apparatus.
Figure 4:
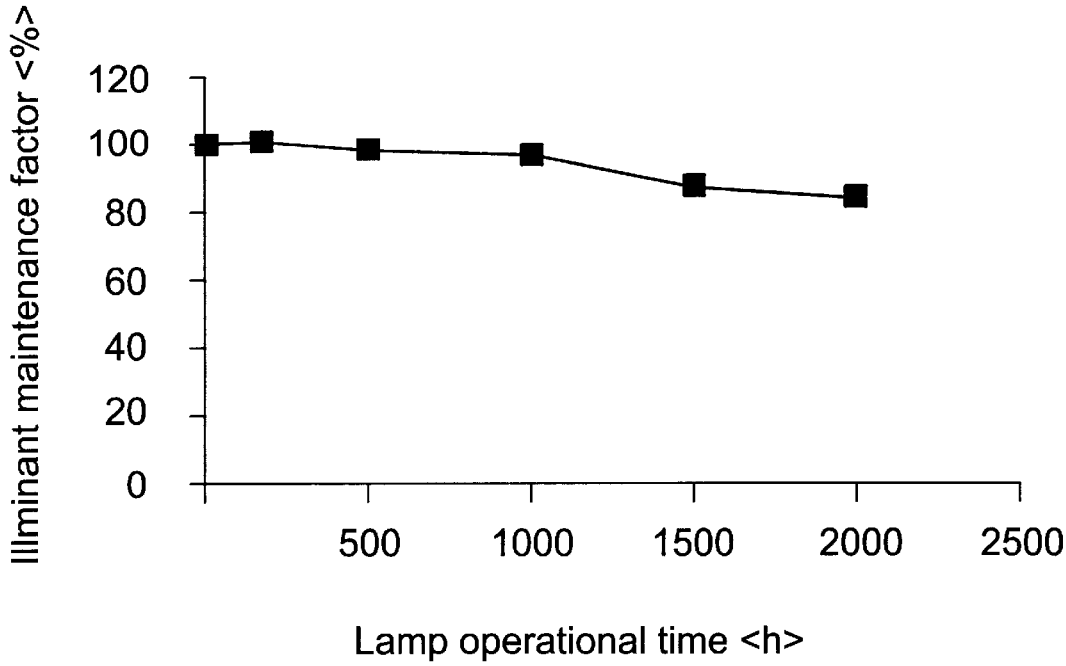
FIG. 4 is a graph showing illuminant maintenance as a function of lamp operational time.

FIG. 3 is a cross section of a high-pressure mercury discharge lamp apparatus. FIG. 4 is a graph showing a relationship between illuminant maintenance factor and lamp operational time. A second embodiment of the invention will be explained with reference to these figures. A high-pressure mercury discharge lamp apparatus is shown in FIG. 3. It includes a high-pressure mercury discharge lamp 11 (of the type described above), a reflector 12 fixing the lamp end, a transparent plate 16 covering an opening of the reflector and a wire assembly 15 provided with a connector 15*a* and a pair of insulated wires 15*b*, 15*c*.

The reflector comprises a concave body 12*a*, a film 12*b* formed on parabolic inner surface of the body and a neck portion 12*c* continuously formed from the body 12*a*. The film, which is called the dichroic film, is able to reflect visible light and to transmit infrared radiation. The reflector may be made of glass or metal. Either of them is able to reduce the infrared radiation reflected on the inner surface by means of the dichroic film.

There are various ways to fix the transparent plate 16 to an opening of the reflector. Examples include: silicone adhesive agent, glass having low melting point and mechanical supporting means. Therefore, if the lamp breaks, the plate 16 prevents scattering of broken pieces. Transparent plate 16 may have a film coated thereon, which is able to transmit visible light and to reflect infrared radiation. Accordingly, it is further able to drop energy of the infrared radiation.

The transparent plate 16 may provide a color filter transmitting particular wavelength of visible light. In this embodiment, the lithium (Li) radiates in the red portion of the spectrum, so that the color filter does not need to compensate the red portion.

The lamp base 5 is fixed in the neck portion 12*c* of the reflector with an inorganic adhesive agent, focusing the center of discharge of the lamp on the focal point of the parabolic surface. Alternatively, lamp base 5 may be detachably disposed in the reflector.

The conductive lead wire 6 is outwardly extended from the reflector through a hole 12*d* made in the reflector body. A connecting terminal 14 is fixed adjacent the hole to join the conductive lead wire 6 to the insulated wire 15*b*. The insulated wire 15*c* is tightened by a nut with the screw terminal 5*b* of the lamp. Connector 15 detachably joins to an other terminal (not shown) of a ballast to start the lamp.

A lamp apparatus arrangement, as described, can be advantageously utilized in a projector, such as a LCD projector, an automobile headlight, spotlight, downlight or a lighting device using an optical fiber. Such apparatus using the lamp as described herein provides improved color rendering and color temperature without sacrificing luminous efficacy.

Table 1 describes a lamp having a wattage of 120 W. Example 1, compared with Example 2, demonstrates a good color property, according to correlated color temperature, chromaticity and general color rendering index. In the lamp of Sample 2, the B/A ratio is 0.13, because the lamp does not include Lithium (Li). Other lamp dimensions of Example 2 are the same the lamp of the Example 1.

TABLE 1

| | CCT | CH | GCR | B/A |
|---|---|---|---|---|
| Example 1 | 7300 | 0.303/0.312 | 70 | 0.35 |
| Example 2 | 9300 | 0.286/0.291 | 61 | 0.13 |

Figure 5:
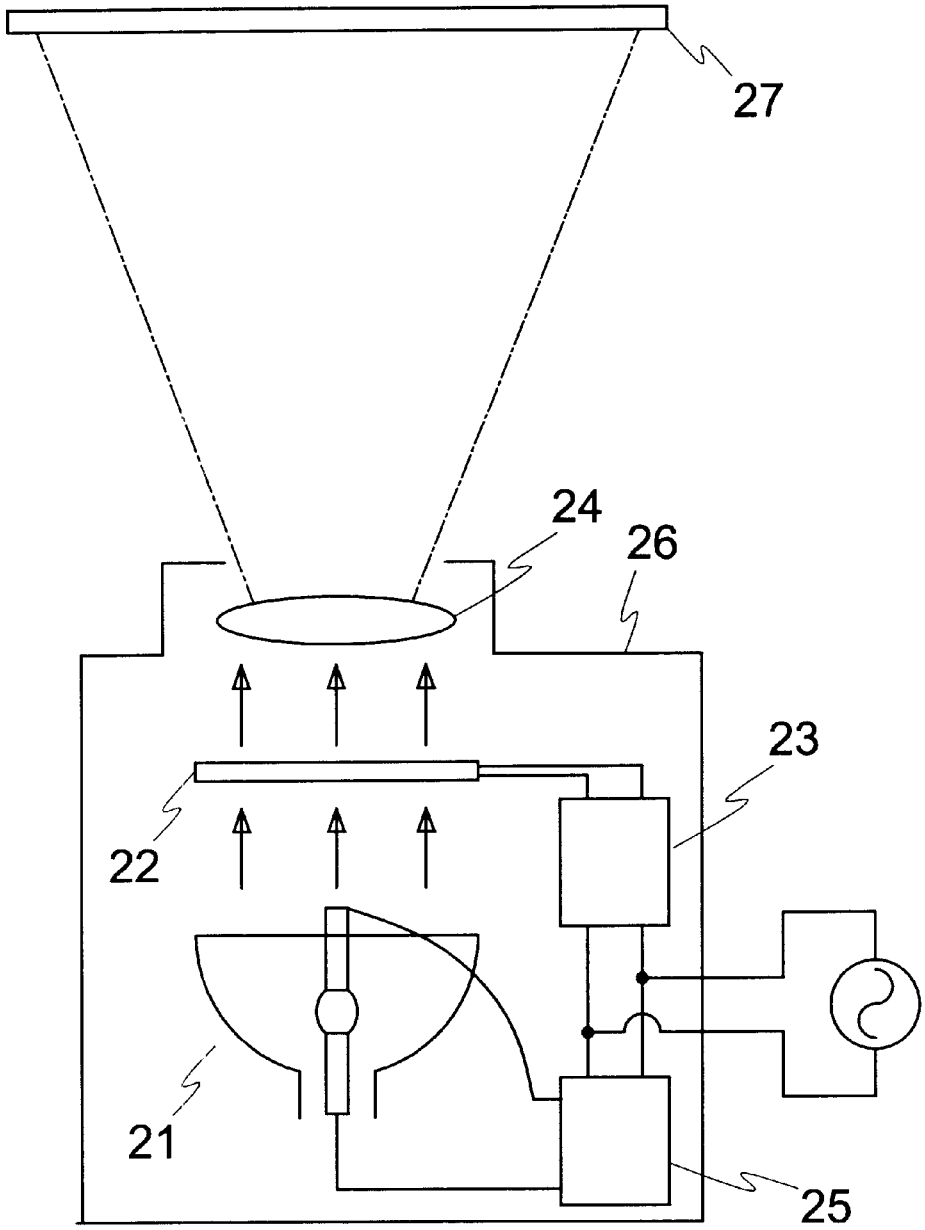
FIG. 5 is an illustration of LCD apparatus using the high-pressure mercury discharge lamp.

CCT = correlated color temperature (K)
CH = chromaticity (X/Y index (Ra)
GCR = general color rendering Table 2 shows a relationship between illuminant maintenance factor and lamp operational time. In this experiment, each of the lamps—Examples 1,3 and 4 is installed in a LCD projector apparatus such as shown in FIG 5. Example 1 has a B/A ratio=0.35, Example 3 has a B/A ratio=0.45 and Example 4 has a B/A ratio=0.55. The illuminant maintenance factor was measured at following time, with operating each lamps until 2000 hours. According to the experiment, it was seen that the lamp preferably had a luminous efficacy of about 55 lm/W or more, a color rendering index (Ra) of about 65 or more and a correlated color temperature within 7000 K to 8000 K.

TABLE 2

| | | Lamp Operational Time | | | |
|---|---|---|---|---|---|
| | B/A | 0 | 500 | 1000 | 2000 |
| Example 1 | .35 | 100% | 100% | 90% | 85% |
| Example 3 | .45 | 100% | 80% | 70% | 50% |
| Example 4 | .55 | 100% | 60% | 35% | |

A general standard for LCD projector apparatus requires approximately a 50% illuminant maintenance factor at 2000 hours of lamp operation. In the lamp of Example 4, the illuminant maintenance factor dropped off considerably at 1000 hours of lamp operation because of discharge vessel whitening.

FIG. 4 is a graphical representation of the illuminant maintenance factor of a 120W lamp based on operational time. The illuminant maintenance factor is plotted on the vertical axis and lamp operational time is plotted on the horizontal axis.

FIG. 5 is an illustration of LCD apparatus using a high-pressure mercury discharge lamp. The LCD projector apparatus is provided with a high-pressure mercury discharge lamp apparatus 21 such as the one shown in FIG. 3. A LCD 22 disposed in front of a lamp arrangement is lighted by a lamp such as the one shown in FIG. 1. An image controlling means 23 controls LCD 22. Controlling means 23 could be any imaging driving device such as a TV tuner, DVD player, Video Tape Player, or a device receiving computer generated images, streaming video and the like. Pictures from LCD 22 are projected on to a screen 27 via an optical element 24 disposed front of the LCD. A ballast circuit 25 helps to start the lamp. A housing 26 encloses the above-mentioned other elements.

In this embodiment, a dichroic film can be formed on the reflector to reflect visible light and to transmit infrared radiation, so that the dichroic film is able to prevent the temperature of the LCD from rising beyond a critical temperature. The reflector may be made of glass or metal. Either of them can reduce the infrared radiation reflected on the dichroic film of the reflector.

The metal halide includes one or more selected from a group of sodium (Na), scandium (Sc) and rare earth elements. Halogen may be at least one kind substance selected from a group of fluorine (F), chlorine (Cl), bromide (Br) and iodide (I). The aforementioned metal halide may be contained about 5 mg to 110 mg per 1 cc by volume of discharge space. The discharge vessel 1 may be made of light transmissible substance, e.g., quartz glass, alumina, ceramics or these single crystals. The thickness of the ellipsoid-shape portion, shown in FIG. 1, surrounding the discharge space 1*c* is thicker relatively.

Moreover, the discharge vessel 1 is filled with ionizable gas, which contains metal halide and rare gas. The metal halide includes at least one metal selected from a group of sodium (Na), scandium (Sc) and rare earth elements. The aforementioned metal halide may be contained about 5 mg to 110 mg per 1 cc by volume of discharge space.

Each of electrodes 1*b*, 1*b* may be formed the same structure, when the metal halide lamp operated using AC power. When the lamp is operated using DC power, such as when the lamp is used in automobile applications, it is suitable that diameter of the tip of electrode is larger than that of the electrode rod.

What is claimed is:

1. A high-pressure mercury discharge lamp comprising:

a light-transmitting discharge vessel defining a discharge space and seal portion;

spaced apart electrodes disposed in the discharge vessel and defining a discharge path; and a filling contained in the discharge vessel including mercury (Hg), a halogen and lithium (Li), the respective amounts of each being selected so as to produce a ratio of relative spectral energies B/A in a range of 0.15 to 0.45; wherein A represents a relative spectral energy of mercury (Hg) within a wavelength range of 402.5 nm to 407.5 nm, and B represents a relative spectral energy of lithium (Li) within a wavelength range of 667.5 nm to 672.5 nm.

2. The lamp according to claim 1, wherein the B/A ratio is in the range of 0.2 to 0.4.

3. The lamp according to claim 1, wherein the halogen is filled with $1*10^{-3}$ $\mu$mol/mm$^3$ or more.

4. The lamp according to claim 1, wherein the lamp has a luminous efficacy of about 55 lm/W or more, a color rendering index (Ra) of about 65 or more and a correlated color temperature within 7000 K to 8000 K.

5. The lamp according to claim 1 wherein the spacing of the electrodes is 0.5 mm to 2.0 mm.

6. A lighting apparatus comprising:

a high-pressure mercury discharge lamp, which includes:

a light-transmitting discharge vessel having a region surrounding a discharge space and seal portion, a spaced apart electrodes disposed in the discharge vessel and defining a discharge path, and a filling contained in the discharge vessel including mercury (Hg), a halogen and lithium (Li), the respective amounts of each being selected so as to produce a ratio of relative spectral energies B/A in a range of 0.15 to 0.45; wherein A represents a relative spectral energy of mercury (Hg) within a wavelength range of 402.5 nm to 407.5 nm, and B represents a relative spectral energy of lithium (Li) within a wavelength range of 667.5 nm to 672.5 nm. a reflector fixing the lamp focusing the center of discharge vessel on the focal point thereof; and a housing accommodating the lamp and the reflector.

7. The lighting apparatus according to claim 6, wherein the B/A ratio is in the range of 0.2 to 0.4.

8. The lighting apparatus according to claim 6, wherein the halogen is filled with $1*10^{-3}$ $\mu$mol/mm$^3$ or more.

9. The lighting apparatus according to claim 6, wherein the lamp has a luminous efficacy of about 55 lm/W or more, a color rendering index (Ra) of about 65 or more and a correlated color temperature within 7000 K to 8000 K.

10. The lighting apparatus according to claim 6 wherein the spacing of the electrodes is 0.5 mm to 2.0 mm.

* * * * *